United States Patent [19]

Howard et al.

[11] Patent Number: 5,050,284

[45] Date of Patent: Sep. 24, 1991

[54] RIVET SETTING APPARATUS AND METHOD OF SETTING A RIVET

[75] Inventors: Stephen F. Howard, Juliet; Terry W. Hopkins, Murfreesboro, both of Tenn.

[73] Assignee: Avco Corporation, Providence, R.I.

[21] Appl. No.: 579,875

[22] Filed: Sep. 7, 1990

[51] Int. Cl.[5] ..... B23P 11/00

[52] U.S. Cl. ..... 29/243.54; 72/391.2; 72/453.17; 72/431

[58] Field of Search ..... 72/403, 391, 453.17, 72/431, 433, 434; 29/243.53, 243.54; 173/131

[56] References Cited

U.S. PATENT DOCUMENTS

| | | | |
|---|---|---|---|
| 1,537,345 | 5/1925 | Gookin . | |
| 2,088,131 | 7/1937 | Cambeis | 153/79 |
| 2,176,304 | 10/1939 | Kalning | 218/15 |
| 2,274,091 | 2/1942 | Pavlecka et al. | 29/243.54 |
| 2,515,674 | 7/1950 | Tisie | 72/434 |
| 3,042,004 | 7/1962 | Fischer et al. | 121/32 |
| 3,724,738 | 4/1973 | Hurst | 227/147 |
| 3,747,194 | 7/1973 | Christensen | 29/243.54 |
| 3,933,025 | 1/1976 | Briles | 72/391 |
| 4,362,216 | 12/1982 | Jansz | 173/131 |

FOREIGN PATENT DOCUMENTS

| | | | |
|---|---|---|---|
| 1391751 | 4/1988 | Japan | 72/433 |

*Primary Examiner*—Lowell A. Larson
*Assistant Examiner*—Michael J. McKeon
*Attorney, Agent, or Firm*—Perman & Green

[57] ABSTRACT

A rivet setting apparatus having a first driver with a rivet deforming piece and an opposite second driver with a rivet deforming piece. One of the rivet deforming pieces has an outer housing with a deforming seat in its front end and an aperture into the deforming seat. Located in the aperture is a movable ram that can extend into the deforming seat. The ram and outer housing are movable at different rates and distances from home positions to deform a rivet.

18 Claims, 1 Drawing Sheet

RIVET SETTING APPARATUS AND METHOD OF SETTING A RIVET

BACKGROUND OF THE INVENTION

1. Field of the Invention

The present invention relates to deforming fasteners and, more particularly, to setting a rivet by deforming its head and tail.

2. Prior Art

Various apparatus and methods have been used in the past to connect members together including the use of rivets that pass through the members and have an enlarged or deformed head and tail on opposite sides of the members. Also in the past, solid rivets have been placed in holes of members and two opposing guns or hammers with deforming dies have been placed at opposite sides of the rivet. The guns are usually provided as either an electromagnetic hammer or a hydraulic or pneumatic hammer. When the guns or hammers are activated, they compress the rivet therebetween and deform the head and tail of the rivet to fix the members being fastened to each other.

A problem has arisen with the use of these types of rivet setting apparatus and methods when they are attempted to be used with relatively long shank rivets. Basically, due to the relatively long length of the rivet shank, during the deformation of the rivet a relatively large amount strain energy is absorbed by the material of the rivet that relieves itself and causes the rivet to expand upon being removed from the rivet setting apparatus. Thus, the head and tail of the rivet do not tightly sandwich the members to therebetween. This results in a poor and movable connection.

It is therefore an objective of the present invention to overcome the problems in the prior art as well as provide additional fasteners.

SUMMARY OF THE INVENTION

The foregoing problems are overcome and other advantages are provided by a new and improved rivet setting apparatus and method of setting a rivet.

In accordance with one embodiment of the present invention a rivet setting apparatus is provided comprising a first driver, a first deforming nose piece, a second driver, and a second deforming nose piece. The first deforming nose piece is connected to the first driver and has a forward deforming seat. The second driver is located opposite the first driver and has the second deforming nose piece connected thereto. The second nose piece has an outer housing and an inner ram. The outer housing has a forward end with a deforming seat and an aperture with a portion of the inner ram movably mounted in the aperture such that the first and second deforming nose pieces can be driven towards each other to deform a rivet therebetween and, the ram and outer housing are adapted to be moved in the same direction, but at different rates of displacement from home positions.

In accordance with another embodiment of the present invention a driving head for use in a rivet setting apparatus is provided. The driving head comprises an outer housing, a ramming plunger, and means for moving the housing and the plunger. The outer housing has a forward end with a deformation recess, an internal cavity, and an aperture passing from the cavity to the recess. The ramming plunger is movably mounted in the internal cavity and has a forward end located in the aperture and extendible into the recess. The means for moving can move the housing and plunger at different rates of speed and different displacement differences from home positions to rivet connection positions to deform a rivet.

In accordance with one method of the present invention, a method of setting a rivet is provided comprising positioning a rivet in holes of members to be riveted; positioning a first deforming tooling at a tail end of the rivet and a second deforming tooling at a head end of the rivet, the second deforming tooling having an outer housing with a front deforming seat and an interior ram extendible into the front deforming seat; and displacing the first and second deforming toolings towards each other thereby deforming the rivet therebetween, the displacement of the second deforming tooling having the outer housing move at a different speed than the interior ram and the ram extending into the front deforming seat at a ram rivet connection position.

BRIEF DESCRIPTION OF THE DRAWINGS

The foregoing aspects and other features of the present invention are explained in the following description, taken in connection with the accompanying drawings, wherein.

DETAILED DESCRIPTION OF THE INVENTION

Figure 1A:
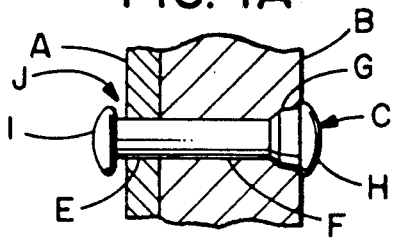
FIG. 1A is a schematic cross sectional view of two members riveted together as known in the prior art.
Figure 1B:
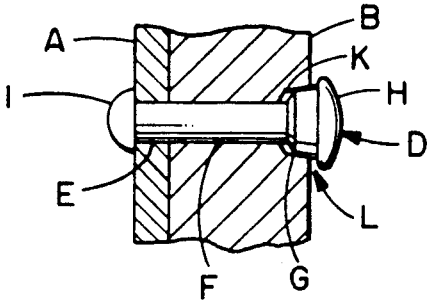
FIG. 1B is a schematic cross sectional view of two members riveted together as known in the prior art.

Referring to FIGS. 1A and 1B, there are shown schematic cross-sectional views of two members A and B connected by rivets C and D showing the problems encountered in the prior art. The rivets C and D are long shank rivets that are initially supplied as a substantially uniform blank rivet (see FIG. 2) without any substantial irregularities at the head or tail of the rivet. The blank rivet is positioned into holes E and F of the members A and B. In the member B shown, the hole F has a countersink enlarged area G. Basically, two guns or hammers are placed at opposite ends of the rivet and driven towards each other and thereby deform the blank rivet by compression to form the rivet head H and rivet tail I intended to sandwich the two members A and B therebetween and make tight contact in the holes E and F.

FIG. 1A shows a long shank rivet after the rivet setting apparatus has been removed wherein the head and tail guns were fired at the same time or with only a short delay or bias between firings. Because of the relatively long length of the rivet, the rivet absorbs some strain energy that is released when the rivet setting appears is removed. As can be seen, although the rivet head H is in its proper location, the rivet expands with the result of the rivet tail I being popped up or having a space J between the tail I and the first member A.

FIG. 1B shows a long shank rivet after the rivet setting apparatus has been removed wherein there was provided a high bias or delay on the rivet tail I. As can be seen, although the rivet tail I is in its proper location, the rivet has nonetheless expanded as a result of the release of strain energy and results in the rivet head H not being properly seated against the second number B and in the countersink area G as evident by void K and spacing L. As noted above, if the head and tail of a rivet do not tightly sandwich the members therebetween, a poor connection results.

Figure 2:
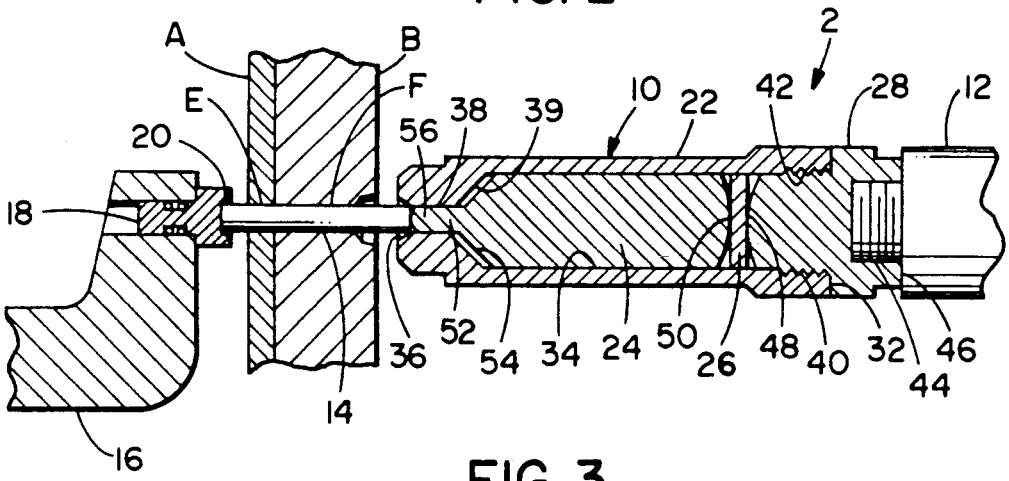
FIG. 2 is a schematic cross sectional side view of a rivet setting apparatus incorporating features of the present invention.
Figure 3:
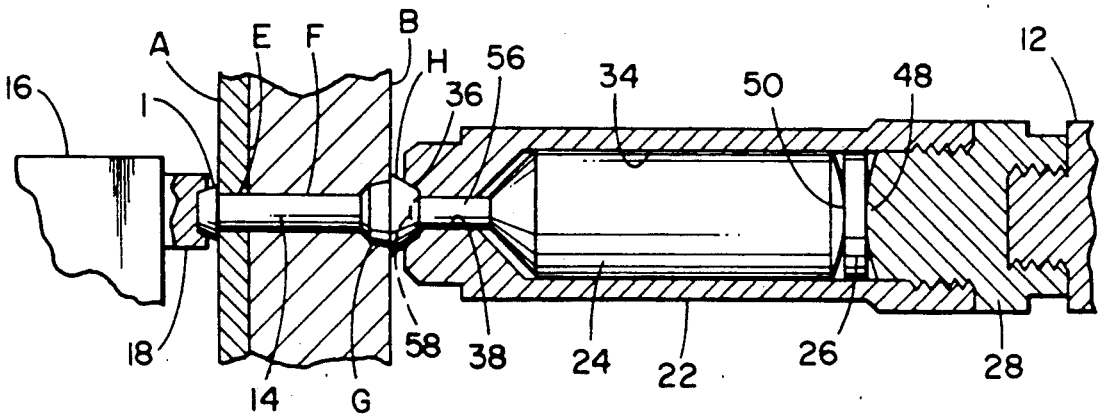
FIG. 3 is a schematic cross sectional side view of the apparatus shown in FIG. 2 with a rivet having been deformed

In order to overcome the disadvantages in the prior art, the present invention provides a new and improved driving head or deforming nose piece. Referring now to FIGS. 2 and 3, there are shown two views of one embodiment of a rivet setting apparatus 2 having a driving head 10 incorporating features of the present invention. Although the present invention is being described with reference to the embodiment shown in the drawings, it should be understood that the present invention may be embodied in many types of alternative embodiments In addition, any suitable type of materials and/or size and shape of elements may be provided.

In FIG. 2 the driving head or deforming nose piece 10 is shown connected to a driver 12. The two members A and B are shown with a blank rivet 14 positioned in their holes E and F. The rivet setting apparatus also has a tail end driver 16 with a tail deforming nose piece 18 having a forward deforming seat 20. The drivers 12 and 16 may be comprised of any suitable hammer or gun type device including pneumatic, hydraulic and electromagnetic guns. The driving head 10, in the embodiment shown, is intended to deform the head of the rivet 14, but may also be provided for deforming the tail of the rivet. In the embodiment shown, the head nose piece 10 has an outer housing 22, an inner ram or ramming plunge 24, a spring disk 26, and a driver adapter 28. The outer housing 22 is preferably made of metal and has a forward end 30, a rear end 32, and an interior cavity 34. Located at the forward end 30 is a deforming seat 36 and an aperture 38 that passes from the interior cavity 34 into the deforming seat 36. The housing 22 has an elongate length and threads 40 at its rear end 32 for connecting the adapter 28 thereto. The adapter 28 has threads 42 for connection to the threads 40 of the housing 22 and threads 44 at its rear end 46 for connection to threads on the driver 12. The front end 48 of the adapter 28, in the embodiment shown, has a curved surface.

In the embodiment shown in FIGS. 2 and 3, the ram 24 and spring disk 26 are located in the interior cavity 34 of the housing 22 and are, at least partially, movably mounted therein. The ram 24 is preferably made of carbide or other dense material. However, any suitable type of material can be used. The ram, in the embodiment shown, has an elongate length with a curved rear end 50 and a front end 52 having a stop ledge 54, a narrow portion 56 and a curved front tip 68. The narrow portion 56 of the ram is positioned in the outer housing aperture 38 and is movable therein. The spring disc 26 is preferably made of metal such as steel. However, any suitable type of material may be used. The disk or plate 26 is substantially flat and is sandwiched between the curved rear end 50 of the ram 24 and the curved front end 48 of the driver adapter 28.

Referring particularly to FIG. 2, the rivet setting apparatus is shown prior to setting of the rivet 14. The two nose pieces 10 and 18 are shown at home retracted positions with the blank rivet 14 positioned in the holes E and F of members A and B and, the ends of the rivet 14 located in the deforming seats 20 and 36. The outer housing 22 and inner ram 24 are both in their home positions with the ram stop ledge 54 being slightly spaced from the housing stop ledge 39, the ram curved front tip 58 projecting into seat 36 and contacting the rivet and, the curved rear end 50 contacting the spring disk 26. The disk 26 is in an undeformed flat profile sandwiched between the ram 24 and adapter 28.

Figure 4:
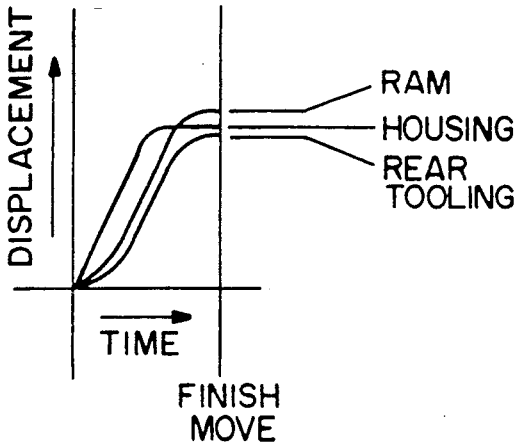
FIG. 4 is a chart indicating time and displacement for the front and rear toolings shown in the embodiments of FIGS. 2 and 3.

Referring now also to FIGS. 3 and 4, the rivet 14 is set by firing the guns 16 and 12 to drive the heads or nose pieces 10 and 18 towards each other. In a preferred embodiment the tail gun 16 is biased or delayed about 30 microseconds relative to the firing of the head gun 12. However, any suitable bias or delay may be provided including no delay or opposite delay. The drivers 12 and 16 accelerate the heads 10 and 18 at a rate of about 1000 to 4000 times the rate of gravity for about one millisecond.

As can be seen in FIG. 4, at this point the novel features of the present invention take effect. The outer housing 22 moves faster than the inner ram 24, at least initially. This is occasioned because of the movable or sliding positioning of the ram 24 in the outer housing interior cavity 34 and the presence of the spring disk 26 between the rear end 50 of the ram 24 and the front end 48 of the driver adapter 28. Generally, as the driver 12 advances forward, it pushes against the driver adapter 28. The driver adapter 28 pushes against the rear end 32 of the outer housing 22 and rear end of the spring disk 26. The spring disk 26 thus pushes against the rear end 50 of the ram 24. The forward end 58 of the ram 24 and seat 36 of the outer housing 22 push against one end of the rivet 14. Because the tail end tooling 18 is also pushing against the opposite end of the rivet 14, the rivet pushes against the ram 24 and outer housing 22. The pressure from the rivet does not significantly affect the movement of the outer housing 22. However, because the spring disk 26 is deformable or compressible, the inertia of the dense ram 24 causes the ram 24 to move back relative to the outer housing 22 in the cavity 34 with the narrow portion 56 of the ram moving back in the aperture 38. The ram 24 is able to move backward in the cavity because the inertia energy is stored in the spring disk 26 and causes the spring disk to compress or deform between the ram 24 and adapter 28. Due to the forces involved, in the embodiment shown, the normal point load of the adapter front end 48 and ram rear end 50 on the two sides of the spring disk 26 at the home position shown in FIG. 2 is transformed into an area load with about 80 percent of the surfaces mating. This occurs due to the deformation of the spring disk 26 between the ram 24 and driver adapter 28. However, in the embodiment shown, this deformation of the spring disk 26 is only temporary. Upon the outer housing 22 reaching the end of its travel or displacement at its rivet connection position, the ram 24 does not stop moving forward. The ram 24 is driven forward at its final stage of travel by the spring disk 26 and its forward inertia. Although the driver 12 stops moving and thus stops advancing the outer housing, the spring disk 26 exerts pressure against the rear end of the ram 24 to move the ram forward. As the ram 24 is pushed forward it presses against the rivet 14 and continues to move forward until it reaches its final rivet connection position as shown in FIG. 3. The movement of the ram 24 a further distance than the outer housing is generally due to the relatively incompressible nature of the material of the ram 24, the slight compression of the outer housing 22 due to its elongate length and slightly compressible or deformable material and, the expansion of the spring disk 26 from its deformed condition back to its substantially flat undeformed condition. It is this expansion of the spring disk 26 and inertial energy that substantially drives the ram 24 forward during its final travel distance to force the front tip 58 of the ram 24 into the deforming seat 36. This movement of the ram into the deforming seat 36 at the end of travel of the driving head 10 causes the indentation to be formed in the rivet head H. Thus, the outer housing deforming seat 36 substantially forms the rivet head H, but the further deformation of the rivet 14 by ram 24 causes the rivet to deform even further to prevent the formation of any spacings or voids upon removal of the setting apparatus as occurred in the prior art.

As can be seen with reference to FIG. 3, wherein the final rivet is shown and will substantially retain this shape even after the rivet setting apparatus is removed, the tail nose piece 18 has formed the tail I of the rivet. The head nose piece 10 has formed the head H of the rivet. Both the head and tail are flush against the members A and B with the head H properly filling the countersink hole G. Unlike the rivet D shown in FIG. 1B, because of the displacement of material at the head H by the ram 24 making its indentation after the head H is substantially formed by deforming seat 36 of the outer housing 22, there is no spacing of the head H from the number B and there is no void in the countersink hole G. Thus, a good rivet connection has been made. FIG. 4 shows the graph of one application of the invention wherein the rear tooling or nose piece 18 is moved from a home position to a rivet connection position a distance of about 0.11 inch. Also in this one application, the outer housing 22 of the front tooling or nose piece 10 is moved about 0.13 inch from a home position to a rivet connection position and, the ram 24 is moved about 0.144 inch from a home position to a rivet connection position. However, any suitable displacements can be provided and any suitable differences between speeds or accelerations of the outer housing and ram can also be provided.

The present invention obviously has many advantages over the prior art. In addition to making a good rivet connection, the relative simplicity of the driving head 10 allows the head 10 to be manufactured, used and repaired at a relatively inexpensive cost. In addition, no other additional driving means for separately diving the ram need be provided. Of course, a separate ram driver could be provided if desired. In addition, the front tip 58 of the ram 24 may have a home position that does not project into the deforming seat 36.

Let it be understood that the the foregoing description is only illustrative of the invention. Various alternatives and modifications can be devised by those skilled in the art without departing from the spirit of the invention. Accordingly, the present invention is intended to embrace all such alternatives, modifications and variances which fall within the scope of the appended claims.

What is claimed is:

1. A rivet setting apparatus comprising:

a first driver;

a first deforming nose piece connected to said first driver and having a forward deforming seat;

a second driver opposite said first driver; and a second deforming nose piece connected to said second driver, said second nose piece having an outer housing and an inner ram, said outer housing having a forward end with a deforming seat and an aperture with a portion of said inner ram movably mounted in said aperture such that said first and second deforming nose pieces can be driven towards each other to deform a rivet therebetween and, said ram and said outer housing are adapted to be moved in the same direction, but at different rates of displacement from home positions, such that said ram and outer housing can sequentially deform a rivet.

2. An apparatus as in claim 1 wherein said second deforming nose piece is connected to said second driver at a rear end of said outer housing by a driver adapter.

3. An apparatus as in claim 2 wherein said second deforming nose piece comprises a spring member disposed in said outer housing between said driver adapter and a rear end of said inner ram.

4. An apparatus as in claim 1 wherein said inner ram has a forward end with a curved tip that extends into said aperture.

5. An apparatus as in claim 1 wherein said second deforming nose piece comprises means to displace said outer housing and inner ram different distances from home positions.

6. An apparatus as in claim 1 wherein said inner ram is comprised of a substantially dense material.

7. An apparatus as in claim 1 further comprising a spring disc disposed between said inner ram and said second driver.

8. An apparatus as in claim 1 wherein said second deforming nose piece comprises means for displacing said outer housing and said inner ram at different rates of displacement from home positions to rivet connection positions.

9. A driving head for use in a rivet setting apparatus, the driving head comprising:

an outer housing having a forward end with a deformation recess for contacting and deforming a rivet, an internal cavity, and an aperture passing from said cavity to said recess;

a ramming plunger movably mounted in said internal cavity and having a forward end located in said aperture and extendable into said recess; and means for moving said housing and said plunger at different rates of displacements and different displacement distances from home positions to rivet connection positions to deform a rivet, said rivet connection positions comprising said front end of said plunger extending into said recess.

10. A driving head as in claim 9 further comprising a driver adapter connected to said outer housing adapted to connect said outer housing to the rivet setting apparatus.

11. A driving head as in claim 10 wherein said means for moving comprises a metal disc located between said plunger and said driver adapter.

12. A driving head as in claim 9 wherein said means for moving comprises a spring located in said internal cavity.

13. A driving head as in claim 9 wherein said outer housing is comprised of metal and said plunger is comprised of carbide.

14. A method of setting a rivet comprising:

positioning a rivet in holes of members to be riveted;

positioning a first deforming tooling at a tail end of the rivet and a second deforming tooling at a head end of the rivet, the second deforming tooling having an outer housing with a front deforming seat and an interior ram extendable into the front deforming seat; and displacing the first deforming tooling and second deforming tooling towards each other thereby deforming the rivet therebetween, the displacement of the second deforming tooling having the outer housing move at a different rate of displacement than the interior ram, at least partially, and the ram extending into the front deforming seat at a ram rivet connection position, the displacement of the second deforming tooling causing a sequential deformation of the rivet, a firs step of the outer housing and ram deforming the rivet and a second step of the ram deforming the rivet as the outer housing remains substantially stationary.

15. A method as in claim 14 wherein the step of displacing the first and second deforming toolings starts at different times.

16. A method as in claim 14 wherein the displacement of the second deforming tooling has the outer housing and interior ram move different distances from home positions to rivet connection positions.

17. A method as in claim 14 wherein the displacement of the outer housing and interior ram is performed by a driver with a metal member positioned between the ram and driver that is deformable to initially reduce the rate of movement of the ram relative to the outer housing and then accelerate the rate of movement of the ram relative to the outer housing during movement of the second deforming tooling towards a rivet connection position.

18. A method of setting a rivet comprising:

positioning a rivet in holes of members to be riveted;

positioning a first deforming tooling at a tail end of the rivet and a second deforming tooling at a head end of the rivet, the second deforming tooling having an outer housing with a front deforming set and an interior ram extendable into the front deforming seat; and displacing the first deforming tooling towards the second deforming tooling thereby deforming the rivet therebetween, the displacement of the second deforming tooling having the outer housing move a first distance from a home position to a rivet connection position with the rivet being deformed by the outer housing and, having the interior ram move a second distance from a home position to a rivet connection position, the second distance being greater than the first distance such that the ram projects into the front deforming seat at the rivet connection position.

* * * * *